US007121870B1

(12) United States Patent
Chen

(10) Patent No.: US 7,121,870 B1
(45) Date of Patent: Oct. 17, 2006

(54) IDC TERMINAL ASSEMBLY

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 11/217,362

(22) Filed: Sep. 2, 2005

(30) Foreign Application Priority Data

Jul. 1, 2005 (TW) ..... 94211184 U

(51) Int. Cl.
*H01R 11/20* (2006.01)

(52) U.S. Cl. ..... 439/404

(58) Field of Classification Search ..... 439/403, 439/402, 404, 941
See application file for complete search history.

(56) References Cited

U.S. PATENT DOCUMENTS

| | | | | |
|---|---|---|---|---|
| 3,189,863 | A * | 6/1965 | Leach | 439/418 |
| 4,964,812 | A * | 10/1990 | Siemon et al. | 439/403 |
| 5,199,899 | A * | 4/1993 | Ittah | 439/403 |
| 5,226,835 | A * | 7/1993 | Baker et al. | 439/403 |
| 5,567,173 | A * | 10/1996 | Franckx | 439/418 |
| 6,379,198 | B1 * | 4/2002 | Arnett et al. | 439/825 |
| 6,626,694 | B1 * | 9/2003 | Zielke et al. | 439/404 |
| 6,648,670 | B1 | 11/2003 | Chen | |
| 6,716,054 | B1 * | 4/2004 | Denovich et al. | 439/404 |
| 6,799,988 | B1 * | 10/2004 | Mansur | 439/404 |
| 6,923,672 | B1 | 8/2005 | Chen | |
| 2002/0001995 | A1 * | 1/2002 | Lin et al. | 439/402 |
| 2004/0192103 | A1 * | 9/2004 | Lee | 439/404 |

* cited by examiner

*Primary Examiner*—Tulsidas C. Patel
*Assistant Examiner*—Vladimir Imas
(74) *Attorney, Agent, or Firm*—Harness, Dickey & Pierce, P.L.C.

(57) ABSTRACT

An IDC terminal structure includes a plurality of terminal pairs and a terminal seat. Each of the terminal pairs has a first terminal and a second terminal. The terminal seat has a plurality of first and second insert slots. The first and second slots are equally spaced from one another in a staggered manner corresponding to the first and second terminal. At least two of the first terminal has a main extension on a middle portion extended towards the second terminal of the same pair and the first terminal of a neighboring pair. So that the first terminal is close to the second terminal of the same pair and the first terminal of the neighboring pair to generate an induction compensation effect. The first terminals of the neighboring pairs are also close to each other to generate an induction compensation effect.

15 Claims, 8 Drawing Sheets

IDC TERMINAL ASSEMBLY

BACKGROUND OF THE INVENTION

1. Field of Invention

The invention relates to an Insulation Displacement Connection (IDC) terminal, and particularly to an IDC terminal that conforms to EIA/TIA Category 6 standards for transmitting high speed electronic signals and has simple structure.

2. Related Art

In recent years network communication systems have become very popular to transmit data, and widely adopted. As the demand grows for high transmission efficiency with network communication systems, not only higher quality connection lines are required, but also higher quality connectors are required with transmission speed increased. In general, a network communication path consists of a transmission medium and transmission connectors. The transmission medium may be a Twisted Pair, Coaxial Cable, Optical Fiber, etc. The network communication path mentioned above still has drawbacks. Signal quality often deteriorates as the frequency of the network communication system increases. For instance:

1. Near-End Cross Talk (NEXT) phenomenon: When two cables are close to each other and generate induction, interference occurs due to electromagnetism, and Cross Talk phenomenon takes place.

2. Impedance phenomenon: The impedance of the transmission medium has to match the system to transmit signals effectively.

3. Return Loss phenomenon: As the impedance of the transmission system is not continuous, reflections occur and power loss results.

4. Attenuation phenomenon: When the signals are transmitted via the transmission medium, signal intensity and power decay with signal traveling distance.

The standards announced by the Electronic Industries Association (EIA) and TIA are adopted by IEEE. EIA/TIA 568 standards have been included in 802.3u standards. Hence the parameters of transmission media and connectors require confirming these standards, and those conforming to the standards are categorized. At present, Category 6 standards have gradually become the basic requirements. Thus it is necessary to overcome the problems previously discussed.

The conventional IDC terminal assemblies, as shown in FIG. 1, includes IDC terminals 11 arranged in parallel to the longitudinal axis of a terminal seat 12. The IDC terminals 11 are equally spaced with one another. Each pair of IDC terminals 11 is interfered with by the neighboring IDC terminals 11. As a result, transmission quality is not desirable. To remedy this problem, many schemes have been proposed. For instance, Siemon Co. proposes to use a metal shield, as shown in FIG. 2A. It has four pairs of IDC terminals 11 that are spaced from one another at a greater interval, and each pair of IDC terminals 11 has a shielding blade 13. The shielding blade 13 of any two pairs of neighboring IDC terminals 11 reduces interference. However, the size of the IDC terminal assembly increases significantly. Material and production costs also are higher.

Panduit Co. proposes a technique with IDC terminals of the same pair arranged staggered on two rows in a front side and rear side fashion. Hence any three neighboring IDC terminals 11 are spaced from one another at about the intervals. Such a design allows any two pairs of neighboring IDC terminals 11 to have TT compensation effect, as shown in FIG. 2B. However, the thickness T of the IDC terminal assembly increases, and the communication core lines cannot be installed by a general wiring machine. U.S. Pat. No. 6,648,670 discloses a design with IDC terminals spaced from one another at an unequal interval. The interval of one pair of terminals is smaller than the interval of the neighboring IDC terminals of different pair. A diagonal assembly and an extending blade are adopted to enhance the compensation effect between different pairs of terminals of the same line position attribute. Its diagonal assembly design can reduce the thickness of the total IDC terminal structure. However, the wiring machine has to be altered to wire the communication core to adopt the design of the diagonal assembly and unequal intervals. Moreover, the corresponding connectors also have to be changed. The connectors adopted in the conventional IDC terminal assembly cannot be used.

SUMMARY OF THE INVENTION

In view of the aforesaid problems, the object of the invention is to provide an IDC terminal assembly to improve the compensation effect, enhance transmission quality, which communication core lines can be installed by a general wiring machine, and that enhances bonding of the terminal seat and the IDC terminals.

In order to achieve the object, the IDC terminal assembly of the invention includes a plurality of terminal pairs and a terminal seat. Each of the terminal pairs includes a first terminal and a second terminal coupled with core lines by wiring or soldering. The terminal seat has a plurality of first insert slots and a plurality of second insert slots. The first insert slots and second insert slots are spaced from one another in a stagger manner and are formed in pairs corresponding to the first terminal and the second terminal. The first terminal of at least two terminal pairs has a main extension in the middle portion extended towards the second terminal of the same terminal pair. The main extension also extends towards the first terminal of a neighboring terminal pair so that the first terminal is close to the second terminal of the same terminal pair and is also close to the first terminal of the neighboring terminal pair. Hence a capacitance effect is generated between the first terminal and the second terminal of the same terminal pair to generate a TR compensation effect. Since the first terminals of the neighboring terminal pairs are also close to each other, an inductance effect is generated to generate a TT or RR compensation effect. Therefore the performance of the IDC terminal assembly is enhanced.

The main extension is substantially parallel to the long axis of the terminal seat. It has two fastening apertures. The first terminal and the second terminal have corresponding fastening apertures. A cover plate is provided to anchor the terminals. So that assembling of the IDC terminal assembly is easier and IDC terminals are mounted on the terminal seat securely.

The first terminal and the second terminal of the invention are arranged in the same fashion as the conventional techniques, thus a general wiring machine can be used to install communication core lines. There is no need to use a special wiring machine to do installation as with the reference previously discussed. In addition, the generally used connectors may be directly used without alteration. The main extension makes the terminals of the same terminal pair close to each other to increase the capacitance compensation effect. The terminals of different terminal pairs that have the same line position attributes also are close to each other to generate an inductance compensation effect. Thereby transmission quality improves. The fastening aperture on the main extension can be coupled with anchor pins of the cover plate to mount the terminals securely.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
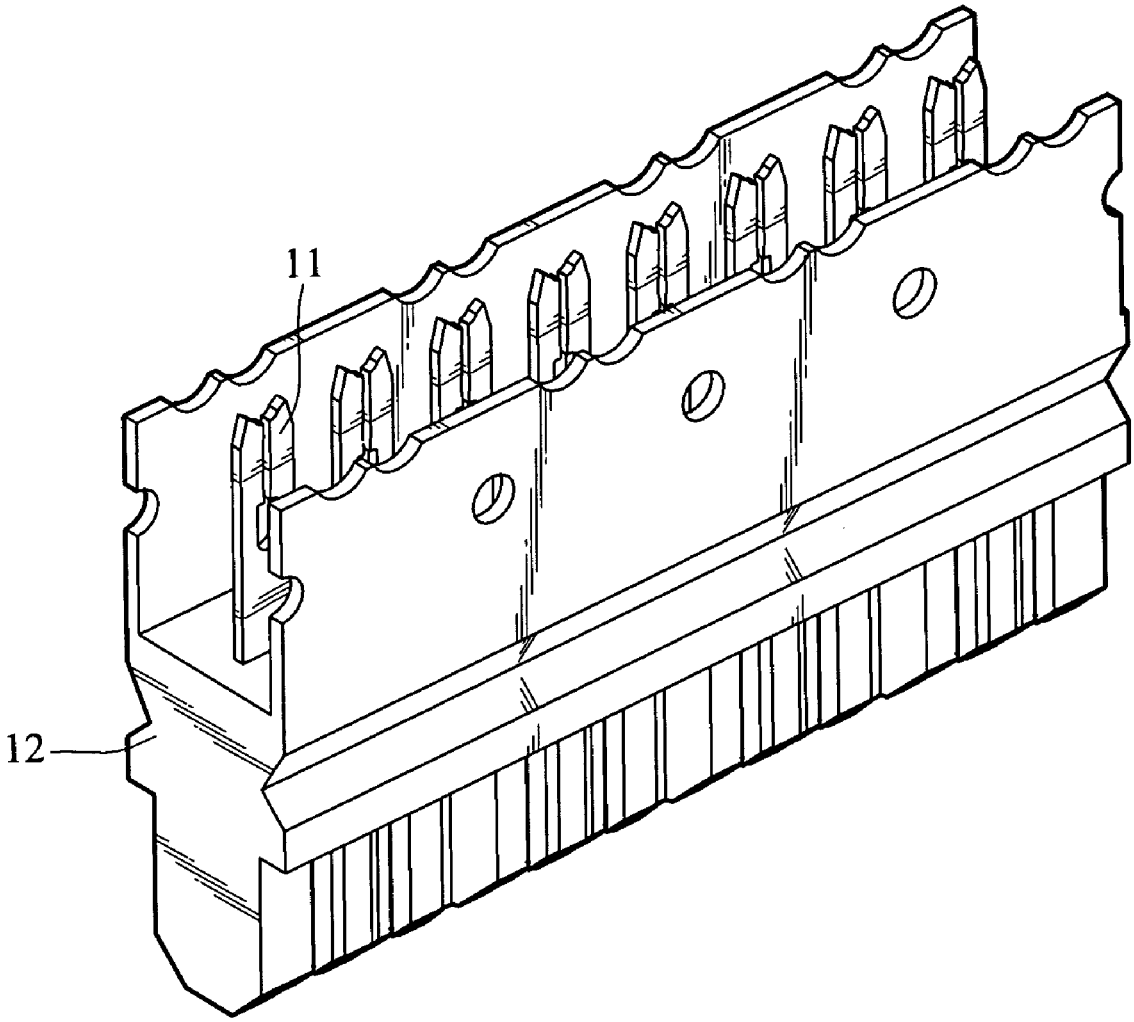
FIG.1 (PRIOR ART)
FIG. 1 is a schematic view of an IDC terminal assembly of a prior art.
Figure 2A:
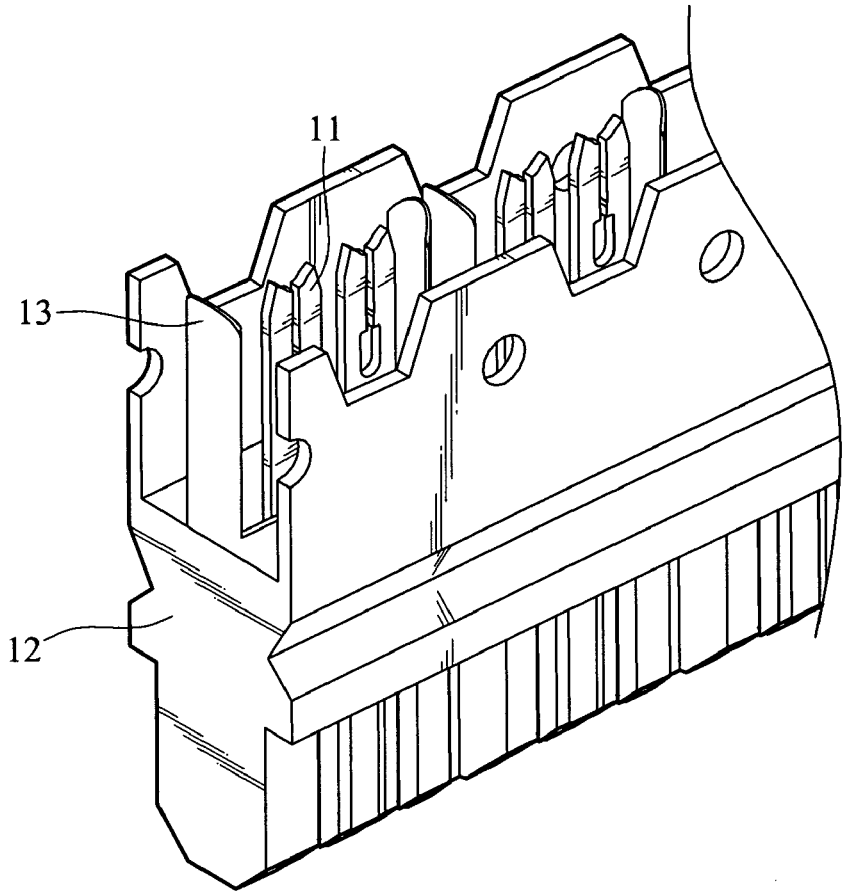
FIG.2A (PRIOR ART)
FIGS. 2A and 2B are schematic views of an IDC terminal assembly of a prior art.
Figure 2B:
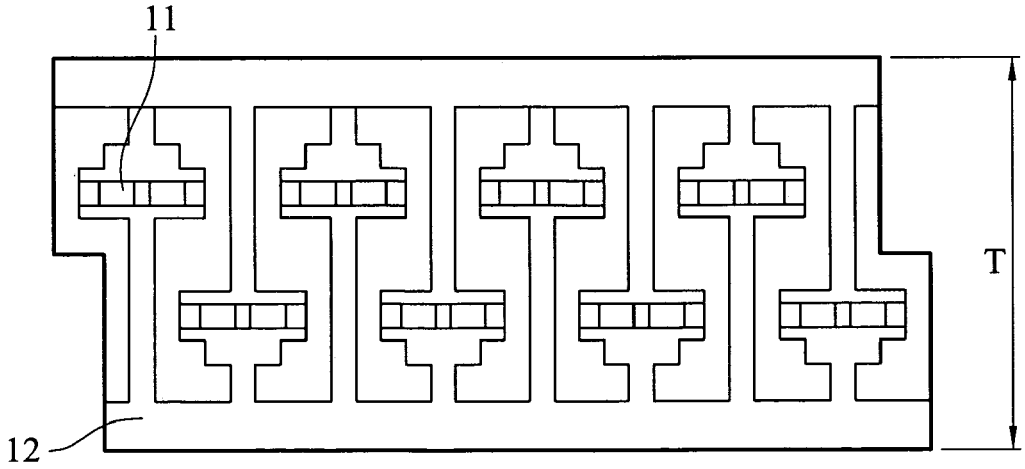
FIG.2B (PRIOR ART)
Figure 3:
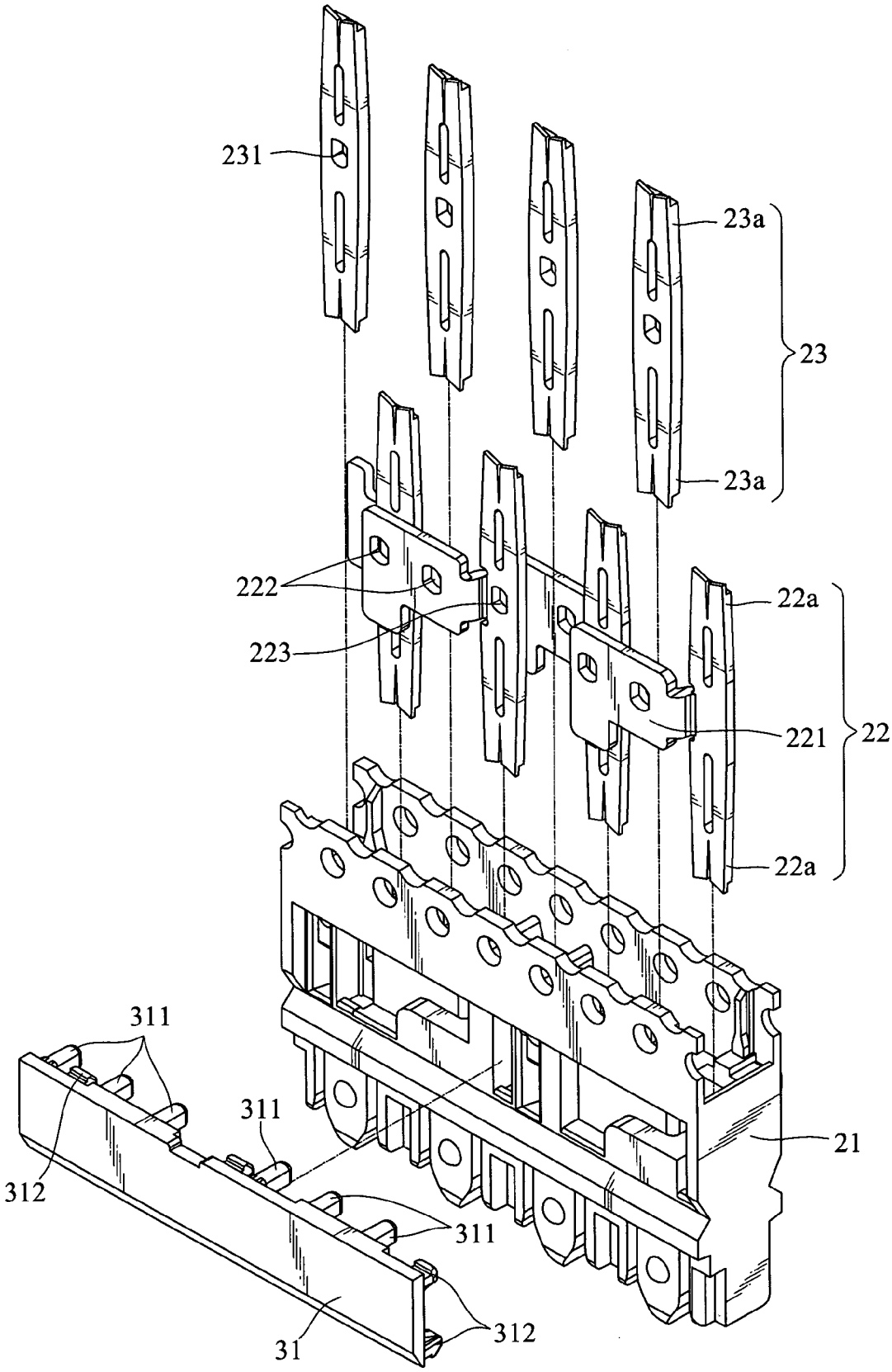
FIG. 3 is an exploded view of a first embodiment of the invention.
Figure 4:
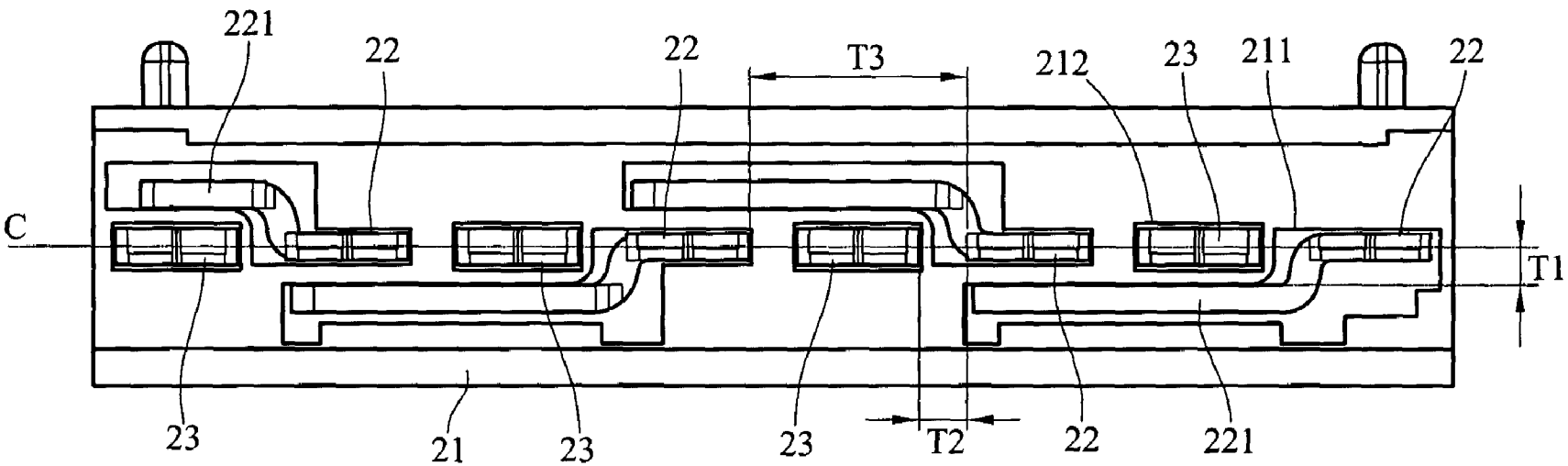
FIG. 4 is a top view of the first embodiment of the invention.

Refer to FIGS. 3 and 4 for a first embodiment of the Insulation Displacement Connection (IDC) terminal assembly of the invention. It includes a terminal seat 21 and a plurality of IDC terminal pairs. Each of the terminal pairs includes a first terminal 22 and a second terminal 23 that are IDC terminals, and are single-head or dual-head according to requirements. In this embodiment the first terminal 22 and the second terminal 23 dual-head that have two IDC ends 22*a* and 23*a* on two ends to become the IDC terminals of double piercing ends. In general, an IDC terminal assembly has four terminal pairs. Hence in this embodiment four terminal pairs are used for discussion. That is, there are four pairs, each with a first terminal 22 and a second terminal 23.

The terminal seat 21 has a plurality of first insert slots 211 and second insert slots 212 that are formed in pairs to hold the paired first terminal 22 and the second terminal 23. The first insert slots 211 and the second insert slots 212 are equally spaced from one another in a staggered manner, so that after the first terminal 22 and the second terminal 23 are installed on the terminal seat 21, they also are positioned in a spaced and staggered manner. The first insert slot 211 has an extension space directed sideways towards a neighboring second terminal 23 and another first insert slot 211 abutting the second insert slot 212 to mate with the first terminal 22. The first terminal 22 has a main extension 221 close to the middle portion. When the first terminal is installed in the first insert slot 211 of the terminal seat 21, the main extension 221 is held in the extension space, is directed towards the second terminal 23 of the same terminal pair in parallel to the long axis C of the terminal seat 21, and is directed towards the first terminal 22 of a neighboring terminal pair.

In general, the first terminal 22 and the second terminal 23 have different line position attributes according to their installed positions. From left to right, they are the first terminal 22 and the second terminal 23 of the first pair to the fourth pairs in this order. The first terminal 22 and second terminal 23 are respectively at T (tip) and R (ring) line positions. Namely they are arranged sequentially in a TR, TR. Since interference occurs in the interval between different line positions, when the first terminal 22 and the second terminal 23 (TR) of the same pair are closer to each other, the return loss is lower. Hence by arranging the IDC terminals of different pairs that have the same line attributes in a TT, RR to offset the TR effect, cross talk can be reduced. In this embodiment, the main extension 221 of the first terminal 22 is extended towards the second terminal 23 of the same pair, and is also extended towards the first terminal 22 of another pair of IDC terminals. The distance between the first terminal 22 and the second terminal 23 of the same pair is reduced from T2 to T1, while the distance between the first terminals 22 of two neighboring pairs is reduced from T3 to T1. The main extension 221 is close to the second terminal 23 of the same terminal pair and the first terminal 22 of a different terminal pair to generate induction. As the main extension 221 is close to the second terminal 23 of the same terminal pair, a capacitance effect between the first terminal 22 and the second terminal 23 of the same terminal pair is enhanced to generate a TR compensation effect. On the other hand, the main extension 221 is close to the first terminal 22 of the neighboring terminal pair, the distance of the first terminals 22 of the two neighboring terminal pairs decreases, inductance effect increases, hence the TT effect (or RR effect) can be compensated.

The invention does not alter the original form and arrangement of the IDC terminals. The first terminal 22 and the second terminal 23 are arranged in a straight line. The external geometric layout is the same as the conventional IDC terminal structure. Hence the general wiring machine can be employed to do wire bonding and installation of the communication core lines of the IDC terminal assembly. There is no need to use a special wiring machine to do installation, as with the prior art. Moreover, it is not necessary for the first terminal 22 of every terminal pair to have a main extension. As long as the first terminal 22 of two terminal pairs has the main extension 221 directed towards the second terminal 23 of the same terminal pair and the first terminal 22 of a different terminal pair, a compensation effect can be generated. Among the terminal pairs, the first terminal 22 of at least two terminal pairs must have the main extension 221.

The main extension 221 of the first terminal 22 is substantially in parallel to the long axis C of the terminal seat 21, and is extended outwards from two side walls along the long axis of the terminal seat 21 in a staggered fashion. The main extension 221 has two fastening apertures 222. The second terminal 23 has a corresponding fastening aperture 231 and the neighboring first terminal 22 has a corresponding fastening aperture 223 mating with a cover plate 31. The cover plate 31 has a plurality of corresponding anchor pins 311 that run through the fastening apertures 222 of the main extension 221, the fastening aperture 231 of the second terminal 23 of the same terminal pair, and the fastening aperture 223 of the first terminal 22 of the neighboring terminal pair. The cover plate 31 has hooks 312 on the periphery to engage with the terminal seat 21, fasten the cover plate 31 securely to the terminal seat 21, and anchor the first terminal 22 and the second terminal 23 on the terminal seat 21. Installation is simple and easy.

Figure 5:
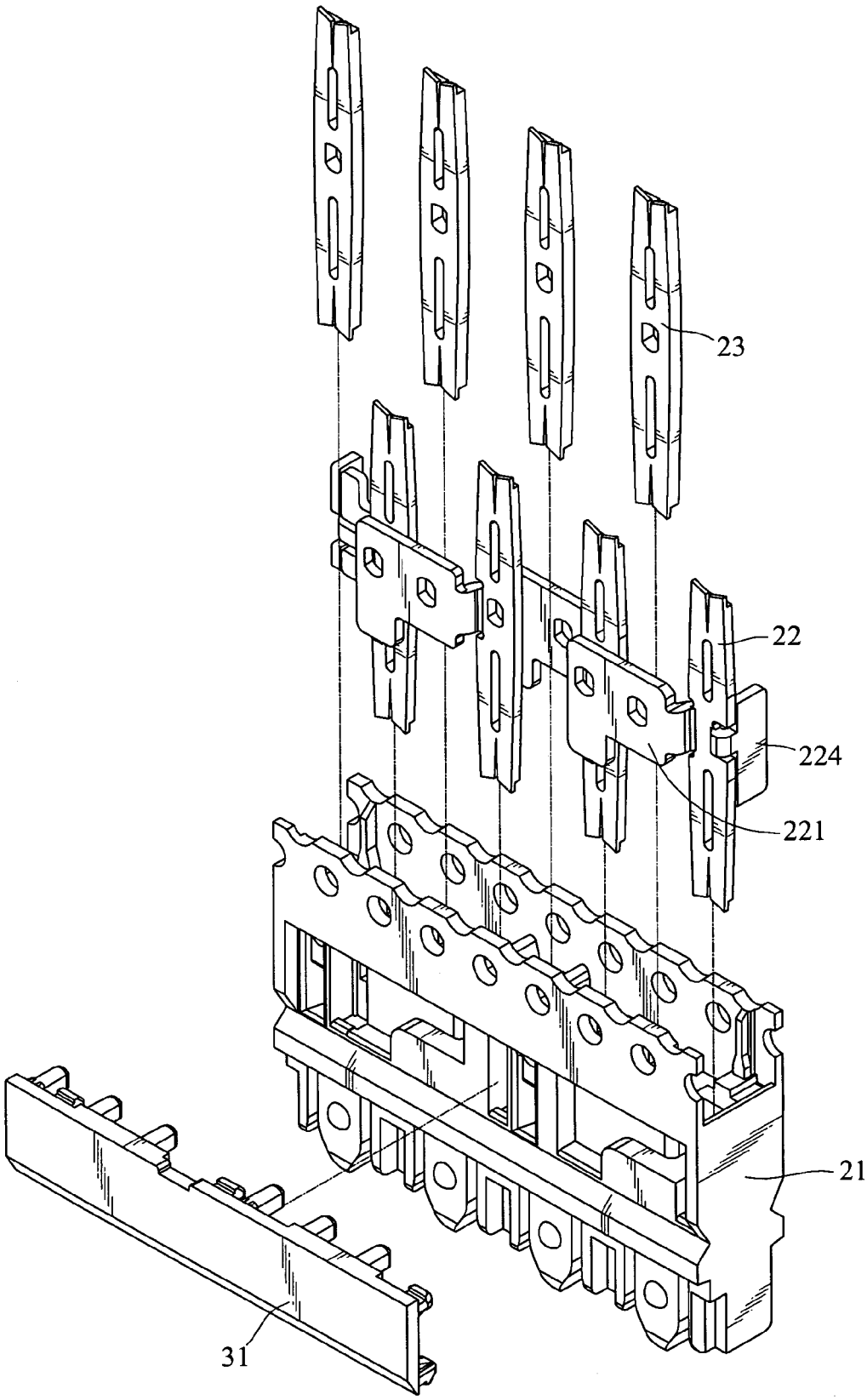
FIG. 5 is an exploded view of a second embodiment of the invention.
Figure 6:
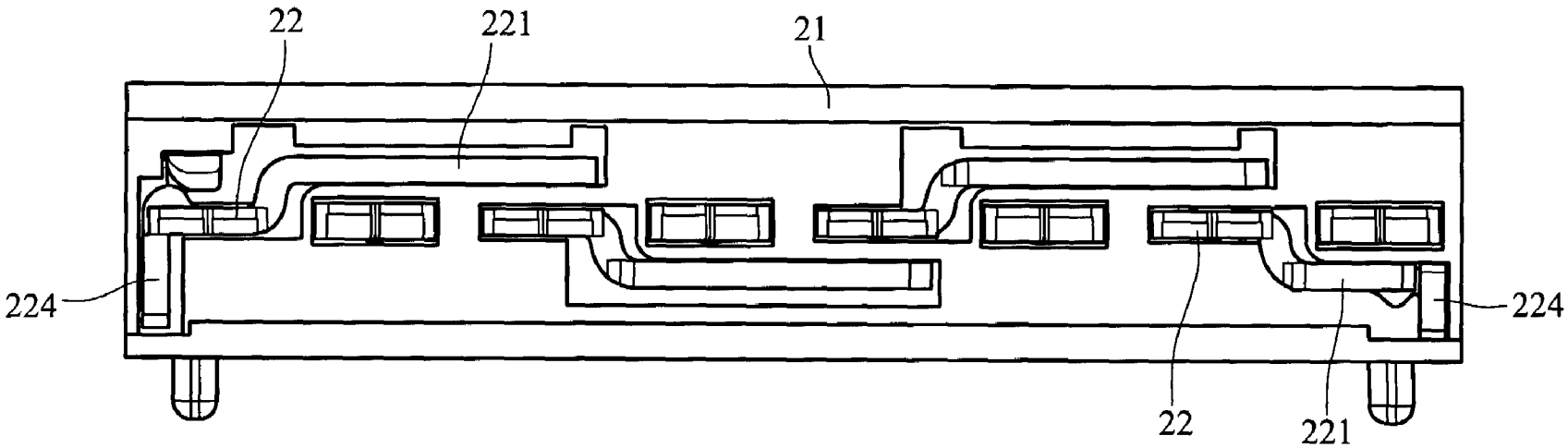
FIG. 6 is a top view of the second embodiment of the invention.

Refer to FIGS. 5 and 6 for a second embodiment of the invention. The first terminals 22 on two ends of the terminal seat 21 on the longitudinal axis and close to two shorter sides thereof have an auxiliary extension 224 parallel to the two short sides of the terminal seat 21. The auxiliary extension 224 is formed in a shape depending on the relative position of the first terminal 22 and the short side of the terminal seat 21. Referring to FIG. 6, the first terminal 22 on the leftmost side of the terminal seat 21 is close to the short side of the terminal seat 21. The auxiliary extension 224 directly extends from the middle portion of the first terminal 22 and is extended in a direction different from the main extension 221. The first terminal 22 on the rightmost side of the terminal seat 21 and the short side of the terminal seat 21 are interposed by the second terminal 23. The main extension 221 is only close to the second terminal 23 without extending towards the first terminal 22 of the neighboring pair (as it is on the edge of the terminal seat 21 without any neighboring IDC terminal). The auxiliary extension 224 is formed on the front edge of the main extension 221, is vertical to the main extension 221 and parallel to the short side of the terminal seat 21.

Figure 7:
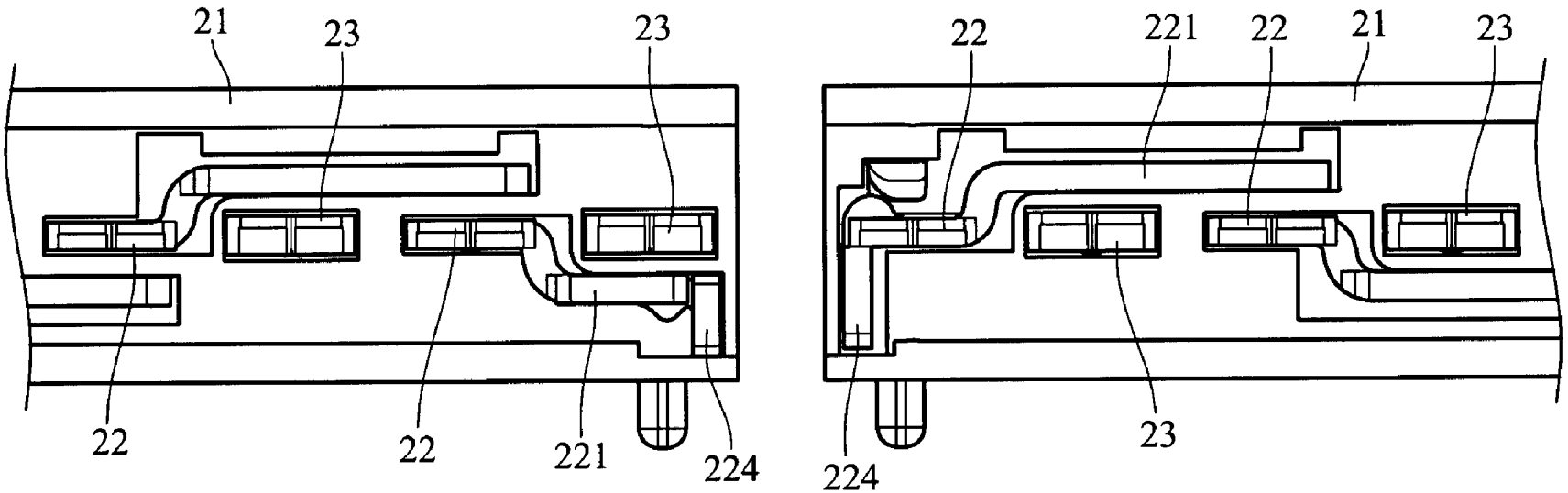
FIG. 7 is a schematic view of the second embodiment of the invention in a use condition.

Referring to FIG. 7, for the first terminals 22 on the two short sides of the terminal seat 21, only one can be close to the IDC terminal of a neighboring pair. Thus, the resulting inductance intensity between the first terminals 22 of the same attributes on the neighboring terminal pairs is lower. The compensating TT or RR effect is also lower than the first terminals 22 in the middle portion of the terminal seat 21.

In the second embodiment, when two terminal seats 21 are abutting, the auxiliary extension 224 on the short side is close to the auxiliary extension 224 of another terminal seat 21. As a result, the first terminal 22 on the short side of the terminal seat 21 is close to the first terminal 22 of another terminal seat 21, and an inductance effect is generated to compensate the TT or RR effect. The originally inferior compensation of the TT or RR effect occurring with the first terminals on the two short sides of the terminal seat 21 can be improved.

Figure 8:
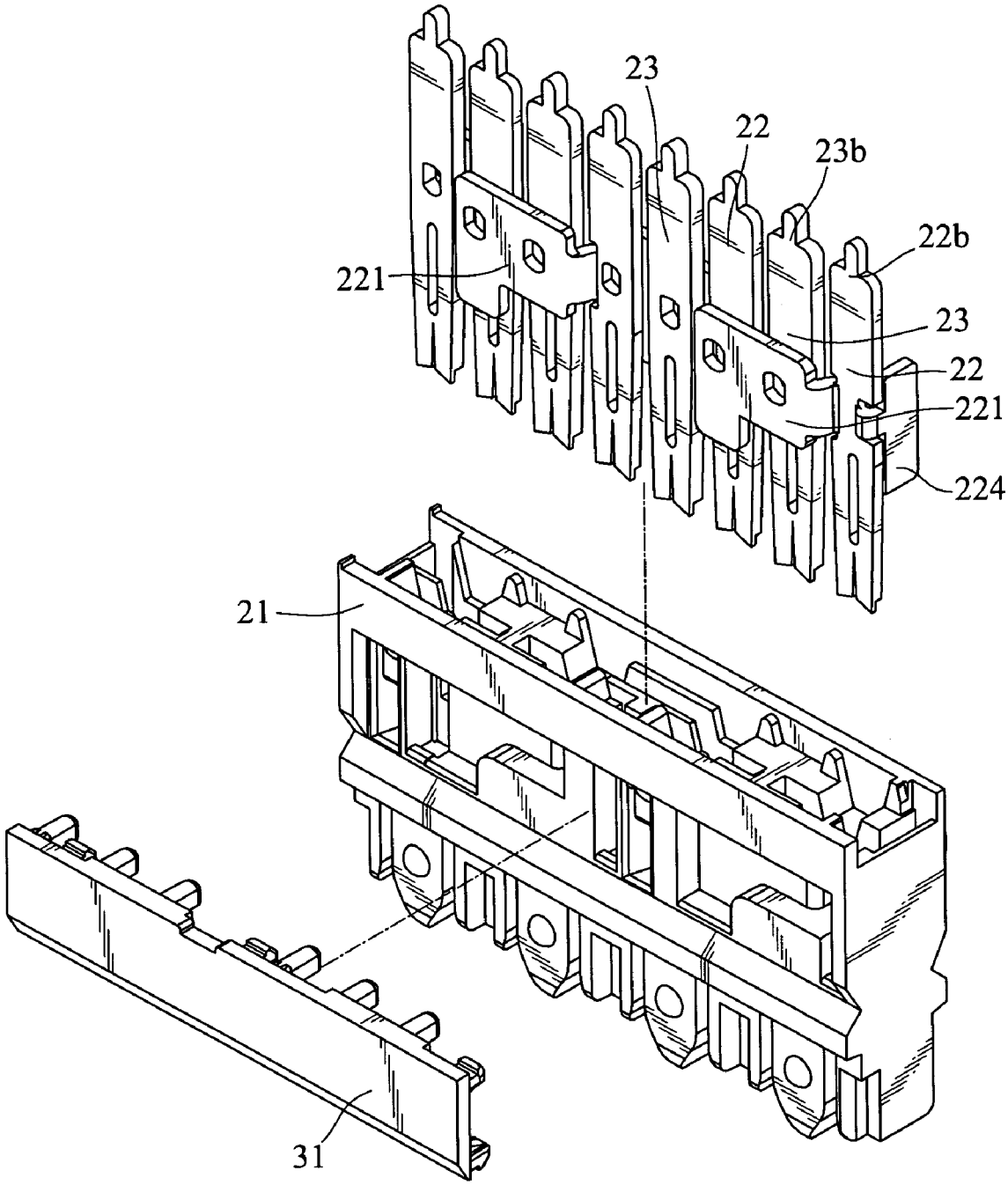
FIG. 8 is an exploded view of a third embodiment of the invention.

As previously discussed, the first terminal and second terminal can be formed with one IDC end or two IDC ends. Refer to FIG. 8 for a third embodiment of the invention. The first terminal 22 and the second terminal 23 are terminals with respectively one IDC end 22*a* and 23*a* to facilitate fast wiring. The other ends of the first terminal 22 and the second terminal 23 become fastening ends 22*b* and 23*b* to be directly fastened to a circuit board or signal lines. The middle portion of the first terminal 22 is designed as in the first embodiment and has a main extension 22 in the middle portion directing sideways. After the first terminal 22 and the second terminal 23 are inserted in the terminal seat 21 in a staggered manner, the main extension 221 is extended towards the second terminal 23 of the same terminal pair, and towards the first terminal 22 of a neighboring terminal pair to generate a compensation effect. The first terminals 22 on the outmost sides have auxiliary extensions 224 to generate induction with the first terminals 22 of different terminal seats to produce a compensation effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An IDC terminal assembly, comprising:

a terminal seat having a plurality of insert slots equally spaced from one another; and a plurality of terminal pairs each having a first terminal and a second terminal to be installed in the plurality of insert slots of the terminal seat in a spaced manner, the first terminal and the second terminal each having at least one IDC end;

wherein a first terminal of at least one of any two adjacent terminal pairs has a main extension formed on a middle portion thereof, the main extension being extended towards a second terminal of the at least one of any two adjacent terminal pairs and a first terminal of a neighboring terminal pair next to the second terminal of the at least one of any two adjacent terminal pairs, such that the main extension of the first terminal of the at least one of any two adjacent terminal pairs overlaps with the second terminal of the at least one of any two adjacent terminal pairs and the first terminal of the neighboring terminal pair.

2. The IDC terminal assembly of claim 1, wherein first terminals on two ends of a long axis of the terminal seat each having an auxiliary extension which is extended parallel to short sides of the terminal seat.

3. The IDC terminal assembly of claim 2, wherein the auxiliary extension is formed on the middle portion of the first terminal.

4. The IDC terminal assembly of claim 2, wherein the auxiliary extension is formed on a front edge of the main extension.

5. The IDC terminal assembly of claim 1, wherein the main extension of the first terminal is substantially in parallel to a longitudinal axis of the terminal seat.

6. The IDC terminal assembly of claim 1, wherein the first terminal and the second terminal are in parallel to a long axis of the terminal seat.

7. The IDC terminal assembly of claim 1, wherein the main extension of the first terminal is arranged in a staggered manner.

8. The IDC terminal assembly of claim 7, wherein the main extension has a plurality of fastening apertures.

9. IDC terminal assembly, comprising:

a terminal seat having a plurality of insert slots equally spaced from one another;

a cover plate having a plurality of anchor pins; and a plurality of terminal pairs each having a first terminal and a second terminal to be installed in the insert slots of the terminal seat in a spaced manner, the first terminal and the second terminal having respectively at least one IDC end;

wherein the first terminal of at least two terminal pairs has a main extension formed on a middle portion thereof, the main extension being extended towards the second terminal of the same terminal pair and the first terminal of a neighboring terminal pair, thereby the main extension of the first terminal is close to the second terminal of the same terminal pair and the first terminal of the neighboring terminal pair, the main extension of the first terminal is arranged in a staggered manner and has a plurality of fastening apertures, the plurality of anchor pins running through the terminal seat and the fastening apertures of the main extension to mount the IDS terminals on the terminal seat.

10. The IDC terminal assembly of claim 9, wherein the first terminals on two ends of a long axis of the terminal seat have respectively an auxiliary extension which is extended parallel to short sides of the terminal seat.

11. The IDC terminal assembly of claim 10, wherein the auxiliary extension is formed on the middle portion of the first terminal.

12. The IDC terminal assembly of claim 10, wherein the auxiliary extension is formed on a front edge of the main extension.

13. The IDC terminal assembly of claim 9, wherein the main extension of the first terminal is substantially in parallel to a longitudinal axis of the terminal seat.

14. The IDC terminal assembly of claim 9, wherein the first terminal and the second terminal are in parallel to a long axis of the terminal seat.

15. The IDS terminal assembly of claim 9, wherein the first terminal has a fastening aperture corresponding to the fastening aperture of the main extension of a different terminal pair, the second terminal having a fastening aperture corresponding to the fastening aperture of the main extension of the same terminal pair, the anchor pins on the cover plate running through the fastening apertures of the main extension and the fastening apertures of the first terminal and the second terminal.

* * * * *